US009339869B2

(12) United States Patent
Chuntonov

(10) Patent No.: US 9,339,869 B2
(45) Date of Patent: May 17, 2016

(54) APPARATUS AND METHOD FOR DROPLET CASTING OF REACTIVE ALLOYS AND APPLICATIONS

(71) Applicant: Konstantin Chuntonov, Nesher (IL)

(72) Inventor: Konstantin Chuntonov, Nesher (IL)

( * ) Notice: Subject to any disclaimer, the term of this patent is extended or adjusted under 35 U.S.C. 154(b) by 0 days.

(21) Appl. No.: 14/351,879

(22) PCT Filed: Oct. 18, 2012

(86) PCT No.: PCT/IL2012/050409
§ 371 (c)(1),
(2) Date: Apr. 15, 2014

(87) PCT Pub. No.: WO2013/072910
PCT Pub. Date: May 23, 2013

(65) Prior Publication Data

US 2014/0290897 A1 Oct. 2, 2014

Related U.S. Application Data

(60) Provisional application No. 61/628,197, filed on Oct. 26, 2011.

(51) Int. Cl.

| | |
|---|---|
| ***B22D 39/02*** | (2006.01) |
| ***B22D 39/06*** | (2006.01) |
| ***C22C 24/00*** | (2006.01) |
| ***B22D 23/06*** | (2006.01) |
| ***C22C 1/00*** | (2006.01) |

(Continued)

(52) U.S. Cl.
CPC ..... *B22D 39/02* (2013.01); *B22D 23/06* (2013.01); *B22D 39/06* (2013.01); *C22C 1/00* (2013.01); *C22C 9/05* (2013.01); *C22C 21/00* (2013.01); *C22C 24/00* (2013.01)

(58) Field of Classification Search
CPC ..... B05B 1/08; B05B 1/24; B05B 1/30; B22D 39/02; B22D 39/06; B22D 23/06; C22C 21/00; C22C 9/05; C22C 1/00; C22C 24/00
USPC ..... 164/284, 303, 259
See application file for complete search history.

(56) References Cited

U.S. PATENT DOCUMENTS

| | | | | |
|---|---|---|---|---|
| 3,142,099 A | | 7/1964 | Burch | |
| 4,842,171 A | * | 6/1989 | Trammel | 222/595 |
| 5,560,543 A | | 10/1996 | Smith et al. | |

(Continued)

FOREIGN PATENT DOCUMENTS

WO 9709142 3/1997

OTHER PUBLICATIONS

"International Search Report (Form PCT/ISA/210)", mailed on Jan. 13, 2013, pp. 1-5, in which the listed references were cited.

(Continued)

*Primary Examiner* — Kevin P Kerns
*Assistant Examiner* — Steven Ha
(74) *Attorney, Agent, or Firm* — Jiang Chyun Intellectual Property Office

(57) ABSTRACT

Apparatus and method for the production of shaped reactive alloys are disclosed. The shaped reactive alloys are obtained by controlled droplet casting in inert atmosphere, wherein the droplets are produced by using mechanical force on a metallic ampoule containing the molten alloy. The manufacture of gas sorbent and elements for vacuum systems according to the above method are also described.

7 Claims, 9 Drawing Sheets

Figure 1:
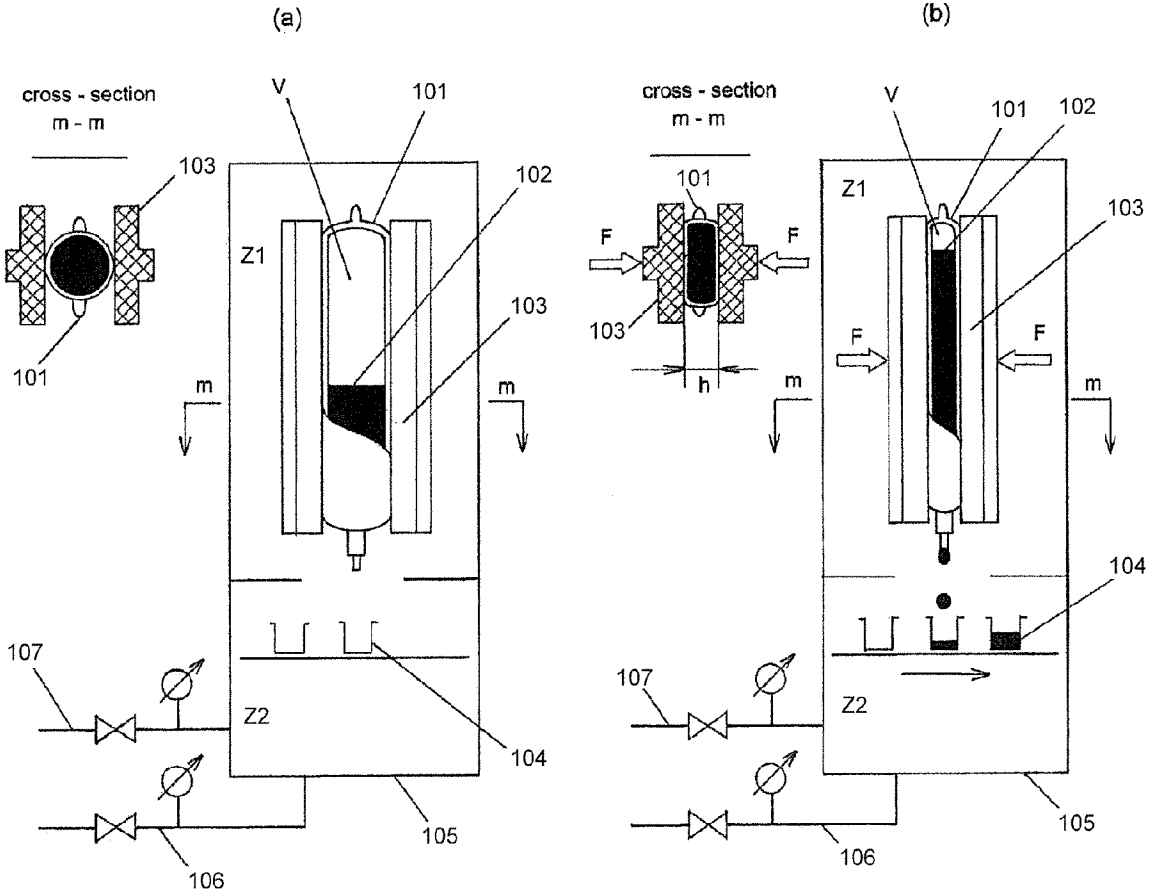

(51) Int. Cl.
*C22C 9/05* (2006.01)
*C22C 21/00* (2006.01)

(56) References Cited

U.S. PATENT DOCUMENTS

| | | | |
|---|---|---|---|
| 5,772,106 | A | 6/1998 | Ayers et al. |
| 6,873,102 | B2 | 3/2005 | Martelli et al. |
| 7,637,403 | B2 | 12/2009 | McGeoch |
| 7,794,630 | B2 | 9/2010 | Cattaneo et al. |
| 2006/0225817 | A1 | 10/2006 | Chuntonov |
| 2010/0242727 | A1 | 9/2010 | Chuntonov |

OTHER PUBLICATIONS

Amster et al., "Monosize Droplet Deposition as a Means to Investigate Droplet Behavior during Spray Deposition", Metallurgical and Material Transaction B, Dec. 2000, pp. 1333-1344, vol. 31.
Liu et al., "On precision droplet-based net-form manufacturing technology", Proceedings of the Institution of Mechanical Engineers, Part B: Journal of Engineering, Oct. 2001, pp. 1333-1335, vol. 215.
Roy Sudesna, "Mono-Size Droplet Production by the Uniform-Droplet Spray Process at High Temperature—with Applications to ASTM F75 and Silicon", Mechanical Engineering Dissertations, Aug. 2009, Total pp. 177.
Chuntonov et al., "The Cs—In Phase Diagram", Journal of the Less-Common Metals, Feb. 1982, pp. 143-153, vol. 83.
MDC, http://www.mdcvacuum.com/displayproductcontent.aspx?d=MDC&p=m.7.2.1.1, retrieved on Apr. 25, 2014, "V-Planer Dual Axis XY Motion & Manipulation XYZ Stages".
Kurt J. Lesker Company, "9th Edition Global Vacuum Product Guide Section 8—Sample Manipulation & Motion", Oct. 2010, Total pp. 78, available at http://www.leskercom/newweb/literature/CDC/PDF_zip/kjlc_ed09_sec08_web200910.zip.
Fransen et al., "The Absorption of Gases by Barium Getter Films applied as a Tool", Vacuum, Feb.-Apr. 1960, pp. 199-203, vol. 10.
B Ferrario, "Chemical pumping in vacuum technology", Vacuum, Apr. 1996, pp. 363-370, vol. 47.
SAES Getters Group, "Page Films Brochure", 2007, Total pp. 9, available at http://www.saesgetters.com/sites/default/files/PaGe_films_brochure_0.pdf.

* cited by examiner

APPARATUS AND METHOD FOR DROPLET CASTING OF REACTIVE ALLOYS AND APPLICATIONS

CROSS-REFERENCE TO RELATED APPLICATION

This application is a 371 application of an international PCT application serial no. PCT/IL2012/050409, filed on Oct. 18, 2012, which claims the priority benefit of U.S. application No. 61/628,197, filed on Oct. 26, 2011. The entirety of each of the above-mentioned patent applications is hereby incorporated by reference herein and made a part of this specification.

I. FIELD OF THE INVENTION

The present invention relates to the field of casting processes, and in particular, to the field of precision droplet casting of reactive alloys.

II. BACKGROUND

Reactive alloys, under which we understand here alloys with high concentration of alkali, alkali—earth as well as some rare-earth metals, are widely used in modern industry and technology. The scale of practical employment of these alloys can sufficiently grow if effective and safe ways of their treatment are found, in particular, methods of their forming, i.e. shaping an alloy into a required geometrical form with the preset dimensions. The forming process of this kind often includes an operation of incorporating the reactive metal with some auxiliary element, e.g. with a support, a shield, a heater, etc., as a result of which not just the material is produced, but already the end product.

Although the chemical activity of metals rapidly grows with the temperature and becomes extremely high after their transition into the liquid state it is the melt, which allows manufacturing of the products of any desired form with the lowest time and material consumption. There are many known methods of precision casting, however, the most suitable for mass production of standardized products is the method of controlled break up of laminar jet called monosize droplet spraying. In the given method the molten metal jet ejected through a capillary orifice breaks up into monosize droplets under the influence of regulated perturbations, which are generated by a piezoelectric transducer. Then the travelling droplets solidify in flight or on a target substrate.

In spite of the constructional variety of atomizers employing capillary instability of liquid jets [S. D. Ayers, D. J. Hayes, M. T. Boldman, D. B. Wallance, U.S. Pat. No. 5,772,106, Jun. 30, 1998; S. Q. Amster, J.-P. Delplanque, W.-H. Lai, E. J. Lavernia, Metall. Trans. B., Vol. 31 B, (2000) 1333-1344; Q. Liu, M. Orme, Proc. Instn. Mech. Engrs., Vol. 215, Part. B (2001) 1333-1355; S. Roy, Mono—size droplet production by the uniform—droplet spray process at high temperature—with Application to ASTM F75 and Ailicon (Dissertation), Northeastern University Boston, Mass., August, 2009], no atomizer, which would be suitable for disintegration of reactive melts, has been created yet.

Reactive alloys with their high chemical activity and volatility impose much stricter requirements to the technical equipment than usual metals. For this reason in the past the demand for active metals was satisfied with the help of redox reactions, where the active metal in a free form appears only as a product of exothermal reaction taking place in the powder mixture of the reducing agent with the chemicals containing a reactive component [D. Marelli, M. Mantovani, G. Urso, U.S. Pat. No. 6,873,102, Mar. 29, 2005; L. Cattoneo, S. Pirola, C. Maeda, A. Bonucci, U.S. Pat. No. 7,794,630, Sep. 14, 2010]. However, the given method has a number of disadvantages and is limited in applications.

The first attempt of dispersing liquid reactive alloys was undertaken in [K. Chuntonov, US Pat. Application 20060225817, Oct. 12, 2006], where for the production of high porosity intermetallic granules of calcium or strontium the technology of quenching of reactive droplets in liquid Ar with the further vacuum sublimation of the excess of Ca or Sr was used. Then this method was modernized for the production of dendritic porous granules based on lithium solid solutions. [K. Chuntonov, US Pat. Application 20100242727 Sep. 30, 2010].

However the method of quenching reactive droplets in the media of liquid coolant is applicable to a rather small number of products of a spherical form. In order to widen the product line of chemically active materials it is necessary to develop a universal method of dispersing reactive melts. Below the solution of this problem with the help of a new generator of single droplets is provided.

III. SUMMARY

An easy method of droplet casting with mechanical forcing of the melt to squeeze through a capillary nozzle has been developed. It is a process of drop by drop type allowing the production of solid bodies of practically any shape and composition in a strictly controlled regime. The accuracy of dosage of the distributed through the capillary melt is determined by the mass of a single droplet, which in its turn is also a regulated (though in a discrete way) value.

The central place in this technology belongs to the generator of droplets, which consists of a metallic ampoule with a capillary nozzle and a press, squeezing the melt from the ampoule through the capillary by gradually flattening the ampoule. In the essence it resembles the procedure of a dozed squeezing of tooth paste or vaseline from the corresponding tubes.

The mentioned ampoule represents by itself a thin-walled metallic tube, one end of which is hermetically sealed and the second one is tightly closed with a metallic stopper with a through capillary protrusion. The reactive alloy is inside the ampoule and the outside of the ampoule contacts two flexible grips, which are elongated along the ampoule and are part of the pressing mechanism.

When the ampoule is heated to the temperature, at which the alloy melts, and the walls of the ampoule become high plasticity and are easy to deform under small efforts, the grips moving toward each other flatten the ampoule and squeeze out of it exactly as much liquid as is required for the given moment according to the requirements of the casting process. The droplets fall into the casting mould and rapidly solidify in it at room temperature.

High precision of dosage is due to the initial and boundary conditions of the process (small height of the molten column, usually 15±5 cm; vacuum above the melt inside the ampoule; the atmosphere of pure Ar at the pressure ~1 bar outside the ampoule), as well as the low pace of squeezing out the melt so that at any moment of time the melt is in the state of a mechanical balance with the environment or close to it. In this situation stopping the moving grips immediately leads to the termination of droplets production. The monitoring of the dropping process and counting the droplets, which separated from the capillary protrusion allows controlling the casting process in any applications of the method: in those, where the product consists of separate droplets as well as in those, where these droplets are to merge forming one ingot.

Another important advantage of the new technology is the protection of the reactive alloy from the chemical contamination and from losses of the volatile component in the heated state. The safety of the reactive material in the given method is provided due to the following measures:

- preparation of the alloy in closed metallic ampoules under vacuum in the conditions of the uniform temperature field;
- drop by drop casting of the melt into the casting moulds at room temperature in Ar atmosphere under the pressure of ~1 bar;
- creation of the protective cover layers on the free surface of the solidified product or using the walls of the casting mould for the same purpose.

The simplicity of the process control and high variability of the drop by drop method allows employing it in solving many problems where reactive alloys have advantages over the rest ones. Due to high speed solidification of small portions of the melt under the above described conditions droplet casting opens practically unlimited opportunities for the production of ingots of any geometrical form of small and medium size.

The present invention mainly describes two groups of applications for the new generator of single droplets: sources of metal vapor in a form of the bodies with the monolithic structure and gas sorbents or catalysts with the porous structure. Both these groups belong to the traditional application fields of reactive metals and alloys.

The representatives of the first one are vapor sources of alkali metals for vacuum photocathodes or organic light emitting diodes (OLED), as well as intermetallic sources of Ba vapor intended for sublimation vacuum pumps or for the production of getter films in sealed—off devices, e.g. in vacuum package MEMS devices. As for the second group, these are porous bulk sorbents capable of chemical sorption of big amounts of active gases, which are used in vacuum technologies and in the processes of gases separation.

Barium vapor sources for micro machined devices according to the given invention are manufactured in a form of micro ingots of the composition $BaMe_2$ on a suitable metallic substrate and barium vapor sources for sublimation vacuum pumps are manufactures in a form of elongate bars of $BaMe_2$ grown inside a wire mesh tube having electrical terminals on its ends. Here Me is the second component of an intermetallic compound, e.g. Ag, Ga, In, etc. or a mixture of such components.

Porous sorbents are produced in a form of intermetallic tablets of the composition $CaMg_2$, $CuMg_2$ or $BaMg_2$ in metallic mesh shell. These tablets are made by the method of building up an ingot on a pedestal inside the metallic mesh casting mould. In this technology the initial melt besides the mentioned components contains also from 10 to 15 at % of sodium, which is further on evaporated from the solidified ingot in vacuum at 200-300° C. for creating of a system of through channels in the bulk of the ingot.

IV. BRIEF DESCRIPTION OF THE DRAWINGS

Figure 2:
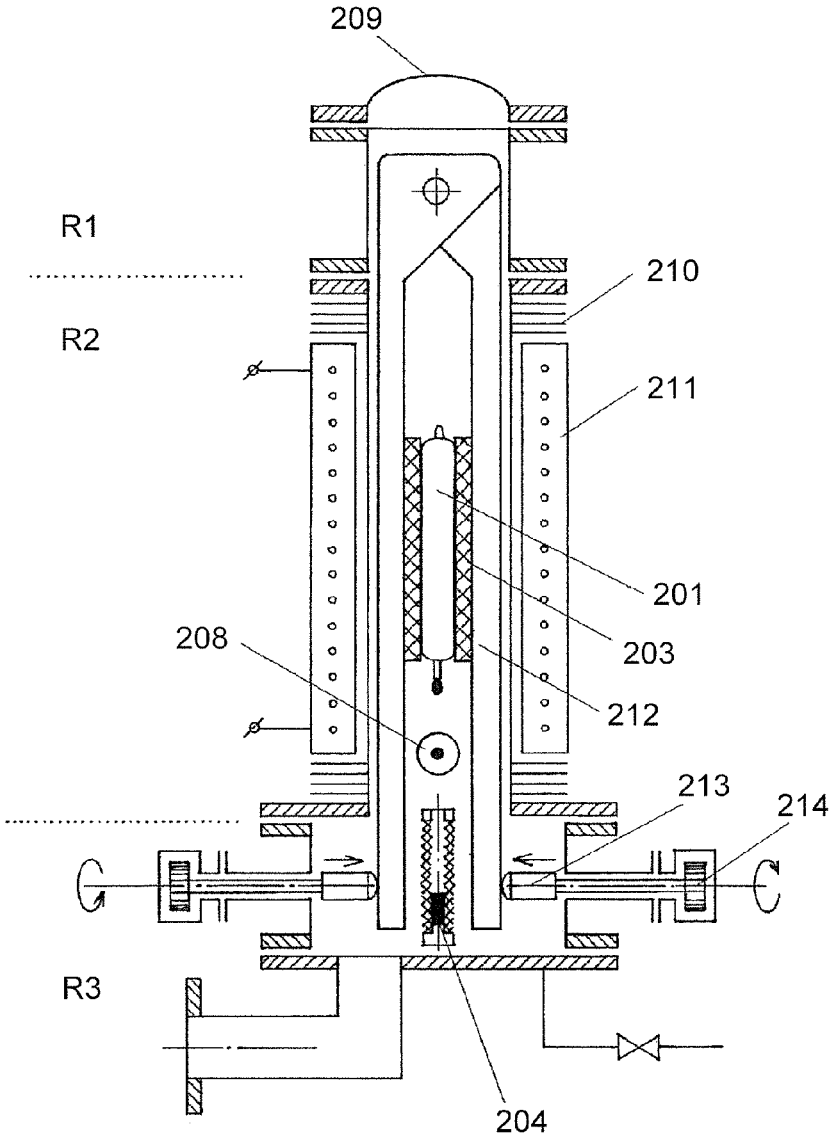
Figure 3:
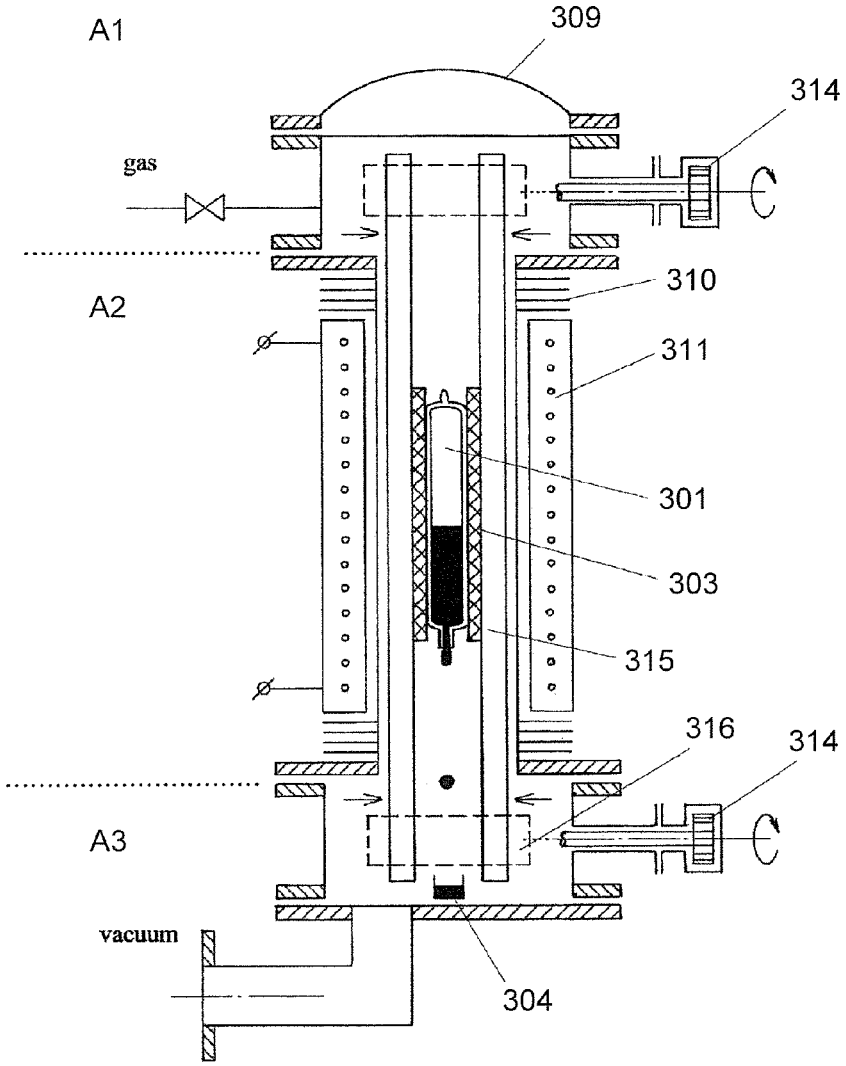
Figure 4A:
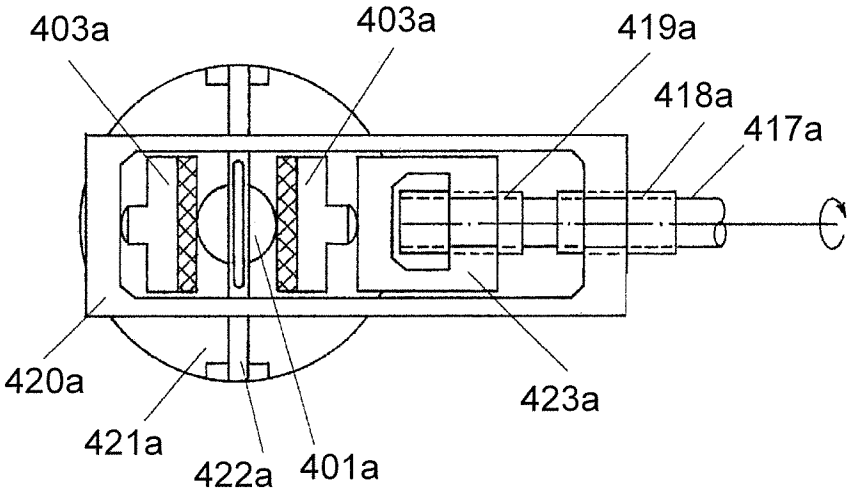
Figure 4B:
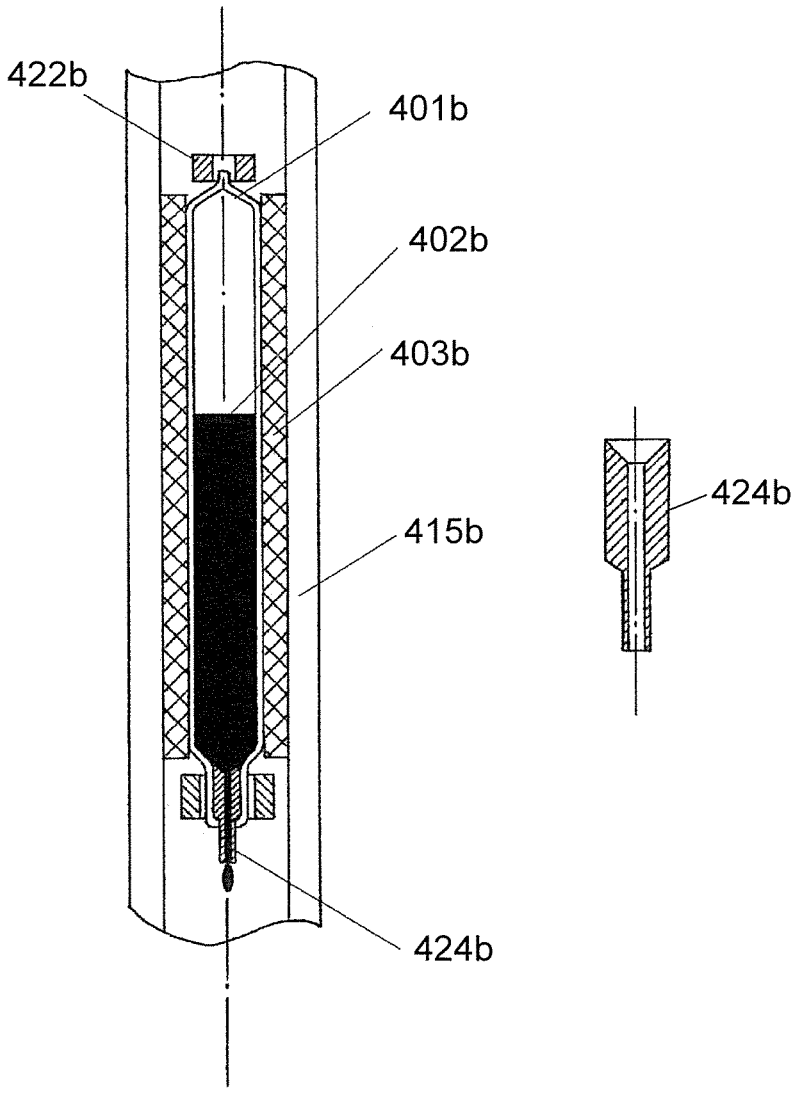
Figure 5:
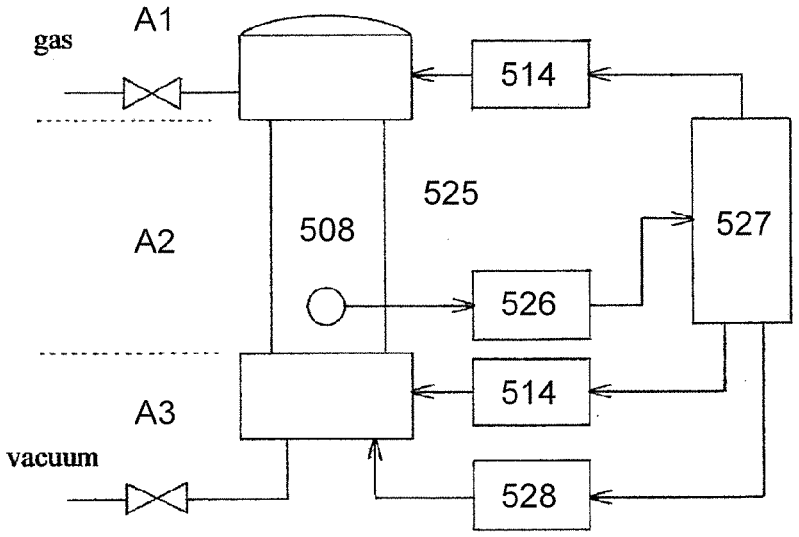

FIG. 1. The idea of the drop by drop method.
FIG. 2. A droplet casting apparatus.
FIG. 3. An alternative variant of the apparatus.
FIG. 4, a. A screw mechanism.
FIG. 4, b. An ampoule with the melt.
FIG. 5. A scheme of control over droplet casting
FIG. 6. A direct filament vapor source of Ba
FIG. 7. Fragments of a vacuum cavity
FIG. 8. A sorption reactor

V. DETAILED DESCRIPTION OF THE INVENTION

The new technique of forming reactive materials by drop by drop method brings the whole process to controlled squeezing the melt out of the heated metallic ampoule through a capillary into a desired casting mould. The squeezed portion of the melt solidifies in a form of a single droplet or an assembly of merged droplets inside the casting mould forming an end product or an intermediate product, which is further subjected to one more treatment for the creation of a system of through pores in the bulk of the material or for the creation of a cover protective layer on its surface.

Reactive alloys with their high chemical activity and volatility require some adjustments in the technology of droplet casting. First, according to the present invention the place, where the initial components are mixed and homogenized, is a closed metallic ampoule situated in a uniform temperature field. Second, droplet casting into casting moulds is performed at room temperature in the atmosphere of pure argon under the pressure ~1 bar, which is much higher than the sum of the partial pressures of the melt components. Third, droplet casting by small portions into cold casting moulds, which have a relatively big mass and high thermal conductivity, leads to rapid solidification of the droplets, actually to their quenching. All this taken together provides chemical homogeneity and constancy of the composition of the produced ingots.

The principle scheme of the method is shown in FIG. 1. A metal ampoule 101 with reactive melt alloy 102 and grips 103 of a press mechanism are in a heating zone Z1, below which a solidification zone Z2 containing casting moulds 104 are situated. Both these zones are parts of the common space inside a hermetic enclosure 105, which is connected to a vacuum and a gas system, which allows creating desired environment outside the ampoule.

Heating of the ampoule can be performed by different methods and one of them consists of using a standard tube furnace covering zone Z1 from the side surface. The solidification zone Z2 can also be heated if necessary although as a rule it stays at room or close to room temperature.

Let us disclose the physical essence of the described method. The driving forces of the melt flow process are the pressure forces in two gas media, one of which is a gas phase above the alloy inside the ampoule and the other one is a gas phase outside the ampoule. In the initial position, i.e. immediately after fixing the ampoule 101 with grips 103 (FIG. 1*a*) in the working position the temperature of the entire system in the range of the enclosure 105 is equal to room temperature. Reactive metal alloy 102 prepared according to the known ampoule technique [K. Chuntonov et. al., Less—Common Metals, 83 (1982) 143-153] is in the solid state and above it there is a free space of the volume V with residual gases under the pressure about $10^{-6}$ mbar. The atmosphere outside the ampoule consists of pure Ar under the pressure of ~1 bar. Separated by solid alloy these two gas areas, one inside the ampoule and another one outside it can stay without any changes practically arbitrary long.

The situation becomes different after melting ingot (reactive metal alloy 102) and preliminary pressing ampoule 101 with grips 103 as shown in FIG. 1(*b*). The pressure in the ampoule above the melt grows abruptly due to two reasons: as a result of a big increase in the partial pressure of the reactive metal and as a result of rapid decrease of the free volume V under the decrease of the gap -h -between grips 103 (FIG. 1(*b*) see section m-m).

So, at heating the ampoule to the temperature $T_L+\Delta T$, where $\Delta T \cong 50°$ C., and the liquidus temperature $T_L$ for alloys belonging to the field of average concentrations of the reactive metal is in the range of $600° C. \leq T_L \leq 900°$ C., the vapor pressure of the reactive metal increases by many orders of magnitude reaching in the average some tens of mbar. Another contribution in the pressure rise inside the ampoule is by its flattening, leading in the first approximation to a dependence of the form of $P \sim A/(Bh-h^2-C)$, where P is the pressure of the gas-vapor mixture above the melt, h is the width of the slit between grips 103, and A and B are constants -and C is a slowly decreasing value.

Thanks to the influence of these two factors, the temperature and the mechanical ones, in the process of pressing the ampoule there comes a moment of the balance of forces when the force of the inside pressure P counterbalances the force of the outside argon pressure taken together with the force of the surface tension of the melt. The further pressing of the ampoule gives the start to the droplet flow of the melt.

The atmosphere of pure argon under the pressure of 1 bar inside the enclosure 105 prevents the loss of the volatile component during the formation of the droplet, its travelling and solidification. If to all that dropping is performed under isothermal conditions, which is natural for the given method, then the mechanical force F (FIG. 1 (*b*)) appears to be the only physical value, which determines the character of the flow process and the casting rate. From the point of view of controlling the casting process this is convenient but at the same time gives rise to specific requirements to the design of the press.

The thing is that droplet flow is a rather slow and close to equilibrium process, where the rate of flattening the ampoule should be adjusted to the dropping rate. If the rate of decreasing the gap h outstrips the dropping rate then the above mentioned dependence P=P(h) will appear and this can cause changing the droplet flow regime to the jet one. As a result controlled casting with exact dosage of the distributed material becomes impossible. In order to exclude this scenario the press should have a high accuracy mechanical part and should be integrated into one control system monitoring the characteristics of the dropping regime. In the present invention it is achieved due to the following solutions:

- using an outside micrometer actuator;
- placing all the sliding and rotating elements of the press mechanism outside the heating zone Z1;
- a special design of grips (jaws) in a form of a combination of temperature-resistant metallic and ceramic constituents of the grips;
- using a droplet counter;
- creating a total system for controlling the casting process subordinated to the droplet counter readings and including the mentioned counter, a controller regulating the operation of the motorized actuator, an actuator, a mechanical press, and a transport mechanism for casting moulds in the solidification zone Z2.

FIG. 2 schematically shows the apparatus for droplet casting with a press mechanism of a hinge type. A lid 209 in the non-heating upper charging department R1 of the apparatus allows replacing a used ampoule 201 for a new one in an open position. Ceramic plates situated in the central heating department R2 and directly contacting the ampoule are mounted on strong mechanical levers 212, which in the lower non-heating department R3 of the apparatus are drawn towards each other by two independent rams 213. The mentioned rams receive the motion from actuators 214, transforming the rotation of the engine into the linear motion of the ram.

A droplet counter placed close to a window 208 in the central heating department R2 monitors the process of filling the casting mould 204 with the melt, so that at the needed moment the mechanism outputting the ready product with the solidified melt works out and the next casting mould is inserted into the freed place. A standard motion and manipulation instrument or an XY stage [see e.g. Catalog MDC, Vacuum Product Corporation or Catalog of Kurt J. Lesker Company], used for transportation of small samples in vacuum chambers, can be used as an input/output mechanism.

One more apparatus with a press of a different type is shown in FIG. 3. Here there are also two actuators but one of them is situated in the upper department of the apparatus and another on in the lower one. Operating synchronously they maintain the strictly parallel position of the grips during their movement toward each other during the pressing of the ampoule. FIG. 4(*a*) and FIG. 4(*b*) help to understand how due to the presence of two screw regions with different screw threads on the shaft, one of them right-hand thread 418*a* and the other one left-hand thread 419*a*, rotation of the shaft 417*a* leads to the linear motion of grips 403*a* into opposite directions, i.e. either coming together or apart. The way of fixing the ampoule inside the apparatus as well as the design of the ampoule are shown in FIG. 4(*b*).

The general scheme of controlling the droplet casting is given in FIG. 5. The apparatus consists of a column 525 with three departments, an upper charging department A1, a central melting department A2, and a lower solidification department A3, where the solidification of the droplets takes place in casting moulds. After evacuating the inside atmosphere of the column 525 and outgassing of the central melting department A2 by heating it to the temperature $T_s-\Delta T$ ($T_s$—the solidus temperature of the alloy and $25° C. \leq \Delta T \leq 50°$ C.) at the pressure of $\sim 10^{-6}$ mbar the apparatus is filled with pure Ar to the pressure of ~1 mbar. Then the temperature of the heating zone is raised to the value $T_L+\Delta T$ beginning at the same time to flatten the ampoule till the first droplets of the melt appear. The droplet counter 526 near the window 508 records this event and transfers the corresponding signal to the controller 527, which controls the operation of the actuators 514 and the mechanism of replacing the casting moulds according to the program corresponding to the manufactured product.

Let us consider some of the particular cases of applying the droplet method to the technology of manufacturing a product containing reactive material. The first group of examples refers to the so called vapor generators usually consisting of containers or a support element and a source of the evaporated metal itself.

Example 1

Manufacturing of Ba—Containing Filaments for Sublimation Vacuum Pumps

Figure 6:
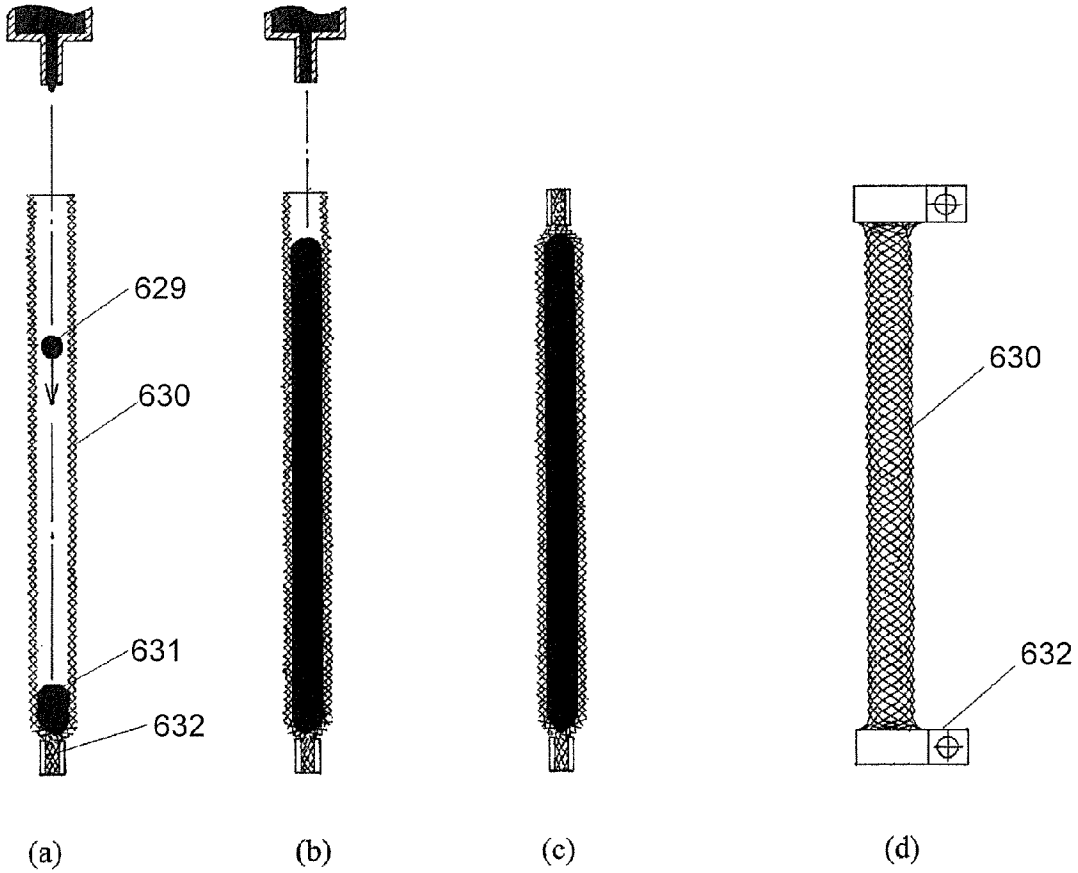

The given filaments consist of a sintered powder mesh or a rolled into a tube metal mesh (e.g. Stainless Steel gauze Type 316 by Alfa Aesar) with high electrical resistance and an intermetallic core $BaMe_2$, grown inside this tube by the pedestal technique (FIG. 6). Droplets 629, the diameter of which is smaller than the inside diameter of the mesh tube, fall flattening on the growing ingot 631 and solidify while the heat is removed to the environment. To reach the maximum output capacity, the frequency of dropping is set a little bit lower than that boundary value, higher than which leaking of the melt through the mesh and formation of a pimple on the outer side of the mesh will start.

After the process is completed the upper unfilled part of the mesh tube is flattened in the same way as its lower part (electrical terminal 632) was flattened before and a flat metallic nozzle is fixed on it for connecting to the feeding electrodes. The final view of the filament is shown in FIG. 6(*d*). Depending on the dimensions of the vacuum chamber the length of this kind of filaments can be from 10 to 20 cm at the diameter of about 3 mm.

Metals like Ag, Ga or In can be used as Me component: they are not volatile and form with Ba compounds $BaMe_2$, which in the cast form are sufficiently stable in the air and at heating in vacuum release barium vapor according to the reaction $$BaMe_2(s) \xrightarrow{T} BaMe_4(s) + Ba(g),$$

where (s) and (g) mean the solid and the gas states accordingly and 550° C.≤T≤700° C. (if Me=Ag, then the solid residual answers the formula $Ag_5Ba$ and not $Ag_4Ba$).

Evaporation rate of barium in such a process is an easily controlled value, which depends on the filament temperature. The solid layer of $BaMe_4$ (or $BaMe_5$), which is formed on the surface of the phase $BaMe_2$ at the evaporation of Ba, due to the strong crystallographic discrepancy with the phase $BaMe_2$ has a porous microstructure, which does not impede the exit of barium vapor outside. Moreover, this cover layer $BaMe_4$ (or $BaMe_5$) performs a useful protective function during the inevitable in the operation of the sublimation pump contacts with the air (at room temperature). In the crystal structure of the above listed phases $BaMe_4$ related to the structural type $Al_4Ba$ direct bonds Ba—Ba going through the entire crystal are absent, which explains the well known stability of these compounds to the influence of the air.

Sublimation pumps with Ba—containing filament can work on the same construction basis as Ti—sublimation pumps having at the same time the following advantages over the latter: sufficiently smaller consumption of electric power; no need in water cooling, fine control over the pumping speed in the wide range as well as the absence of such negative phenomenon as the memory effect.

Example 2

Barium Micro Dispenser for Small Vacuum Chambers

The drop by drop method gives the opportunity to repeat the same industrial advance in the application to small sealed-off chambers as the getter Ba— films had in the CRT technology. Ba evaporable getters (Ba-EGs), which were developed in the past for vacuum maintenance in chambers with a large free volume, produce Ba vapor as a result of an exothermal reaction, which is initiated by RF heating of the powder mixture of $Al_4Ba$ and Ni.

However, this technique is not applicable in the conditions of small vacuum chambers like compact image intensifiers with proximity—focused configuration or MEMS cavity. The new solution is built on different principles, namely, on the thermolysis of micro ingots of $BaMe_2$, which are subjected to a strictly localized heating by laser impulses after sealing of the micro vacuum chamber.

In short, the new technology comes down to the sequence of the following procedures. A droplet of the melt $BaMe_2$ with the mass of several milligrams, e.g. a droplet of $Ag_2Ba$ or $BaGa_2$, etc., is squeezed onto a metal substrate, which is adjusted for the insertion and further fixing inside a small vacuum chamber. If it is required by a specific application, e.g. in connection with a long exposure of the source in the air, the surface of the solidified droplet can be covered with a thin layer of component Me in the neighboring deposition chamber connected with the drop casting apparatus via a sluice chamber.

Figure 7:
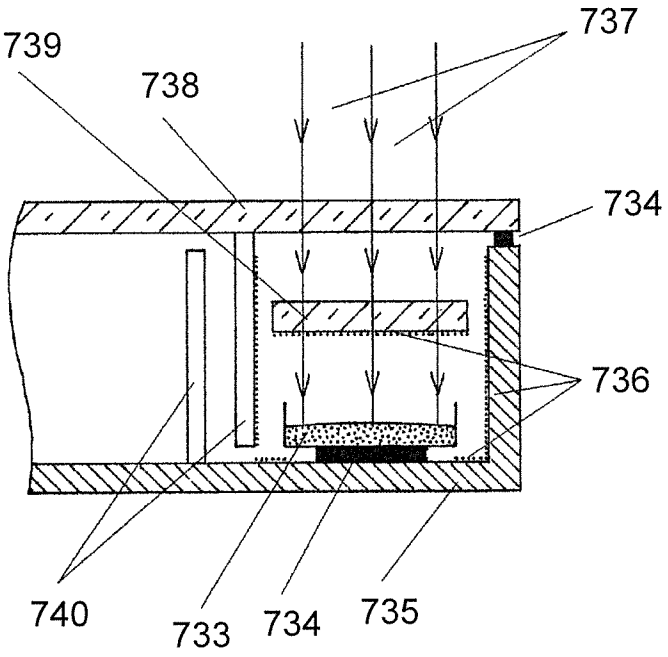

FIG. 7 shows a fragment of a small vacuum chamber illustrating a method of obtaining Ba—film using intermetallic vapor sources of the described type. The substrate with the barium source 733 is fixed with the help of a low temperature solder 734 (or by some other technique) on the bottom 735 of the cavity. A laser beam 737 comes from above through the lid 738 made of glass, quartz or sapphire and heats the surface of the source for the generation of barium vapor. The vapor condenses in a form of film 736 on all the accessible regions of the interior cavity including the transparent for the laser radiation screen 739, which protects the lid 738 from barium atoms.

From the point of view of the needs of sealed—off vacuum chambers Ba films are the best getter material, the sorption capacity of which at room temperature is close to the theoretical limit for all active gases [J. J. B. Fransen, H. J. R. Perdijk, Vacuum, 10 (1960) 199-203; B. Ferrario, Vacuum, 47 (1996) 363-370]. Even the best of the available at present getter films like Page Lid or Page Wafer [SAES Getters Brochure: Page Films, 2007], which were developed for vacuum micro chambers, are much inferior to barium films in sorption capacity. For this reason the described in the present Example new Ba evaporable getters are capable of sufficiently improving the life time of vacuum devices in opto—or microelectronics like Generation III night vision systems, MEMS devices, etc.

The second group of the materials produced by the dropping method consists of high porosity alloys used as catalysts in organic synthesis as well as effective reagents for chemical capturing of active impurities in gas mixtures or in liquid solutions at room temperature or at lower temperature down to a cryogenic range. Depending on the composition these materials can serve dryers, hydrogen storage materials, getters, etc.

Porous alloys are produced by quenching the melt droplets containing some amount of Na in mesh casting moulds, which do not prevent the access of molecules from the environmental gas or liquid medium to the surface of the solidified alloy. At rapid cooling of the droplet sodium segregates during the solidification process in a form of a separate phase, which takes the space between the crystals of the primary intermetallic phase, which forms the dendritic carcass of the ingot. Thanks to the mesh shell the intermetallic tablets have sufficient mechanical strength to withstand the procedure of being poured into the sorption column or a reactor chamber and due to the small area of the cross section of the outlet channels with Na on the ingot surface this charging procedure can be performed in the air or, which is better, in the atmosphere of dry air.

The finishing treatment is performed by heating of the tablets directly at their working place to 200-300° C. at vacuum of ~$10^{-6}$ mbar. Sodium evaporates from the alloy leaving behind open channels with the fresh surface of the intermetallic carcass in the ingot body, and sodium condenses on the designated for this purpose cold parts of the chamber, forming the useful active film.

There is a limited number of binary reactive systems, to which the described method is applicable, however, it is them that are the most effective chemisorbents capable of reacting with active gases at room temperature to completion and without a residual. To this kind of alloys belong: alloys of alkali—earth metals with each other, alloys of alkali—earth metals with Al or with Cu as well as some alloys of alkali—earth metals with lanthanides. Let us describe intermetallic compounds $BaMg_2$, $CuMg_2$ and $CaMg_2$ as an example of these alloys.

Example 3

Intermetallic Porous Tablets

Tablets of the mentioned compositions are produced in the a two—stage process, when in the beginning small mesh baths or plates made of stainless steel gauze are filled with droplets of the melt $(BaMg_2)_{1-x}Na_x$, $(CaMg_2)_{1-x}Na_x$, or $(CuMg_2)_{1-x}$ accordingly, where $0.10 \leq x \leq 0.15$.

Then the tablets (842 in FIG. 8) with a ternary ingot is charged into reactor body 841 and while the gate valve 846 is open all gases are pumped down from the reactor to the pressure of $10^{-6}$ mbar. While the pumping down is continued, the lower part of the reactor is heated by the furnace 843 to 200-300° C. as a result of which sodium begins to evaporate from the ingots condensing on the metallic mesh filter 845, which is cooled with the outside cooler 844.

The heating is stopped when characteristic changes in the pressure of the gas phase of the reactor, which are connected with the disappearance of free sodium in the lower heated part of the reactor, take place. Depending on the nature of the application sodium condensate on the mesh filter 845 can be turned into oxide form, completely or partially, by the dozed inlet of oxygen into the reactor.

After the described procedures are completed the gate valve 846 is closed, the furnace 843 as well as the cooler 844 is dismounted and the reactor is ready for sorption work. This work can be maintenance of vacuum in evacuated vessels or providing a high purity of the noble gases in gas—filled vessels, if the reactor contains tablets of the composition $BaMg_2$. Or this work can be providing a high purity of nitrogen if the sorption reactor is filled with the mixture of $CaMg_2$ and $CuMg_2$ tablets. Other applications of the described product are also possible, e.g. using $CuMg_2$ tablets for capturing hydrogen in gas mixtures or using $CaMg_2$ tablets for deoxygenation and drying of gas mixtures.

So, as follows from the Description and the given EXAMPLES, the present invention is based on two technical solutions:

- on mechanical flattening of the metal ampoule with the melt as the driving force of the droplet forming process;
- on the creation of a casting product of a new type, representing by itself an ingot and a coalesced with its mesh mould, which are integrated and form the end product, in which each part fulfills its own function, the ingot fulfills the function of a sorbent and the mesh fulfills the supporting of the heating function.

VI. DETAILED DESCRIPTION OF THE DRAWINGS

FIG. 1. The idea of drop by drop method:
(a)—the apparatus in the initial state, (b)—the apparatus in the dropping regime;
Z1—the heating zone, Z2—the solidification zone;
101—an ampoule, 102—reactive melt alloy, 103—grips, 104—a casting mould, 105—a hermetic enclosure, 106—a vacuum line, 107—a gas line;
h—width of the gap between the grips, F—pressing force, V—free volume above the melt.

FIG. 2. A droplet casting apparatus:
209—a lid, 210—a thermal shield, 211—a heater, 201—a metallic ampoule, 203—a ceramic plate on a metallic lever, 212—a lever, 213—a ram, 214—an actuator, 204—a casting mould, 208—a window.
R1—the non-heating upper department, R2—the central heating department, R3—the lower non-heating department. The replacement of ampoules is performed while the lid 209 of the charging department R1 is open. The central department R2, which is intended for heating the ampoules and melting the alloy, contains a window 208 allowing observation over the dropping process. A mechanism for moving the casting moulds 204, where solidification takes place, is situated in the lower department R3.

FIG. 3. An alternative variant of the apparatus:
309—a lid, 310—a thermal shield, 311—a heater, 301—a metallic ampoule with the melt, 303—a ceramic plate, 315—a metallic basis of the grip, 316—a screw mechanism, 314—an actuator, 304—a casting mould;
A1—the upper charging department, A2—the central melting department, A3—the lower solidification department.

FIG. 4(*a*). A screw mechanism:
417*a*—a shaft, 418*a*—a screw with right-hand thread, 419*a*—a screw with left-hand thread, 403*a* grips, 420*a*—a frame, 421*a*—the inside space of the column, 422*a*—a crossbar, 401*a*—an ampoule, 423*a*—traveler.

FIG. 4(*b*). An ampoule with the melt:
401*b*—a wall of the ampoule, 402*b*—a melt, 403*b*—a ceramic plate, 415*b*—a metallic base of the grip, 424*b*—a nozzle, 422*b*—a crossbar.
Nozzle 424*b* can be pressed into an ampoule or welded to it.

FIG. 5. A scheme of control over droplet casting:
525—a vertical column, 508—a window for observing the dropping process, 526—a droplet counter, 527—a controller, 514—actuators, 528—a manipulation instrument;
A1—the upper charging department, A2—the central melting department, A3—the lower solidification department.

FIG. 6. A direct filament vapor source of Ba:
(a)—the initial stage of growing the ingot, (b)—the end of the growth process, (c)—the ready product, (d)—the ready product, a side-view;
629—a droplet of $BaMe_2$ melt, 630—a metallic mesh, 631—a growing ingot, 632—an electrical terminal.

FIG. 7. Fragments of a vacuum cavity:
733—a substrate with a micro ingot $BaMe_2$, 734—a solder, 735—a bottom, 736—a Ba—film, 737—a laser beam, 738—a transparent lid, 739—a transparent screen, 740—semi-partitions.

Figure 8:
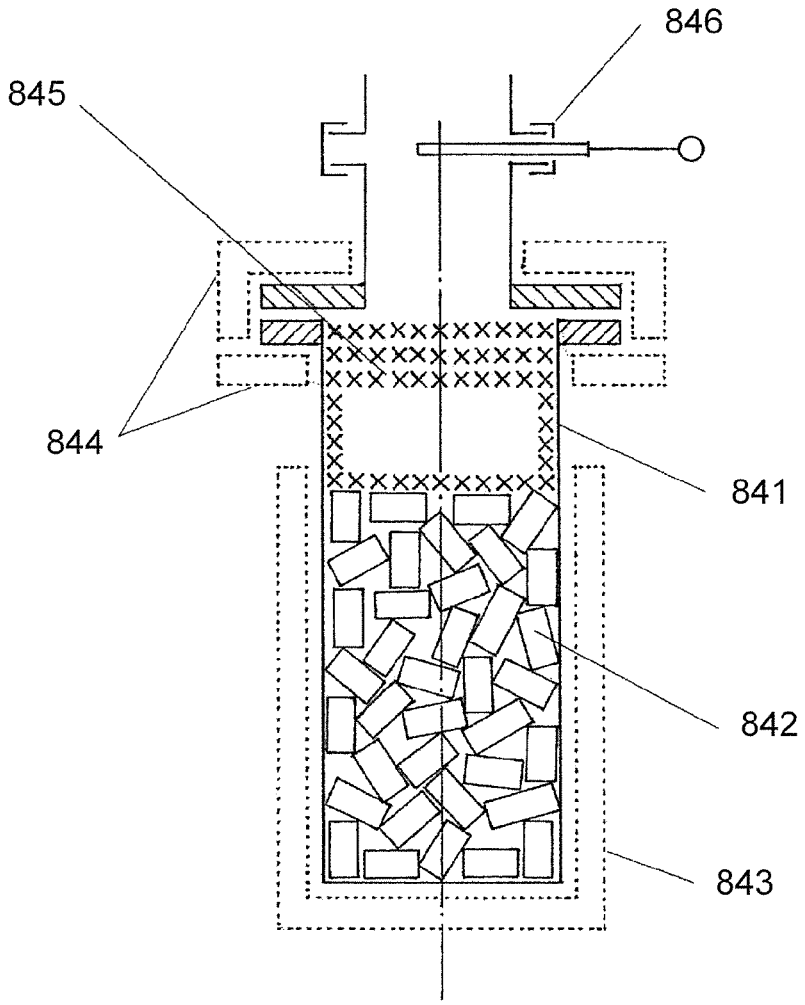

FIG. 8. A sorption reactor:
841—a reactor body, 842—porous tablets of intermetallic gas sorbent, 843—a furnace, 844—a cooler, 845—a mesh filter, 846—a gate valve.

The invention claimed is:

1. An apparatus for controlled droplet casting of a reactive melt alloy with a mechanical press for flattening a heated metallic ampoule and squeezing of the reactive melt alloy through a capillary nozzle into casting moulds by forces provided by gas and the mechanical press to form a plurality of solidified droplets, where the solidified droplets form together with the casting moulds integrated end products, the apparatus comprising:

a column with a hermetic enclosure, where the column comprises a drop generator, the casting moulds with a transport mechanism for the casting moulds, and a window, wherein the drop generator comprises the metallic ampoule with the reactive melt alloy and the mechanical press for flattening of the ampoule; and a system for controlling the casting process, where the system comprises a droplet counter, a motorized actuator for the mechanical press, a controller which controls the operation of the actuators, and a tube furnace covering the column from outside.

2. The apparatus according to claim 1, where the mentioned column further comprises a charging department, a central melting department with the window and with the droplet generator, and a lower solidification department with a mechanism for inlet and outlet of the castings moulds or the integrated end products.

3. The apparatus according to claim 2, wherein the motorized actuator is connected to the mechanical press, the droplet counter is located outside the window of the central melting department of the column, and the controller regulates a rate of a droplet flow with the help of commands sent to the actuator according to readings of the counter.

4. The apparatus according to claim 1, where filling of the casting moulds with the melt and formation of the integrated end product take place in the lower department of the column under argon at room temperature and at a gas pressure in the column of about 1 bar.

5. The apparatus according to claim 4, where the reactive melt alloy comprises barium, the casting moulds are made of stainless steel mesh, and the integrated end products are filaments for sublimation vacuum pumps, a barium micro dispenser for vacuum chambers, or metal gas absorbents, in which a reactive ingot and a metallic mesh casting mould are one integrated whole.

6. The apparatus according to claim 1, where the casting moulds are stainless steel mesh tubes 15±5 cm long with a diameter about 3 mm and the reactive melt alloy has the formula $BaMe_2$ where Me=Ag, Ga, or In.

7. The apparatus according to claim 1, where the casting moulds are baths made by stainless steel mesh and an initial melt has a composition $(BaMg_2)_{1-x}Na_x$, $(CaMg_2)_{1-x}Na_x$, or $(CuMg_2)_{1-x}Na_x$, where $0.10 \leq x \leq 0.15$.

* * * * *